US005615788A

United States Patent [19]

Larguia

[11] Patent Number: 5,615,788

[45] Date of Patent: Apr. 1, 1997

[54] CONTAINER SAFETY CAP

[76] Inventor: Constancio Larguia, Talcahuano 1175 2nd B, Buenos Aires (1013), Argentina

[21] Appl. No.: 513,508

[22] Filed: Aug. 10, 1995

[51] Int. Cl.[6] ..... B65D 41/62; B65D 45/32; B65D 51/18

[52] U.S. Cl. ..... 215/274; 215/253; 215/272; 215/276

[58] Field of Search ..... 215/274, 203, 215/204, 253, 278, 277, 273, 246, 250, 251, 249, 276, 230, 272; 220/256, 257

[56] References Cited

U.S. PATENT DOCUMENTS

| | | | |
|---|---|---|---|
| 1,862,620 | 6/1932 | Graham . | |
| 2,045,480 | 6/1936 | Magnesen et al. | 215/250 |
| 2,144,194 | 1/1939 | Murison | 215/253 X |
| 2,659,511 | 11/1953 | Rice . | |
| 3,013,687 | 12/1961 | Gould | 215/249 |
| 3,156,369 | 11/1964 | Bowes et al. | 215/250 X |
| 4,555,036 | 11/1985 | Bekkers et al. | 215/203 X |
| 4,669,620 | 6/1987 | Coifman | 215/251 X |
| 4,984,700 | 1/1991 | Knickerbocker | 215/251 |
| 5,209,362 | 5/1993 | Lutzker | 215/225 |
| 5,316,163 | 5/1994 | Von Schuckmann | 215/249 |

FOREIGN PATENT DOCUMENTS

| | | | |
|---|---|---|---|
| 1541066 | 8/1967 | France | 215/253 |

*Primary Examiner*—Allan N. Shoap
*Assistant Examiner*—Niki M. Kopsidas
*Attorney, Agent, or Firm*—Keck, Mahin & Cate

[57] ABSTRACT

A container safety cap having an internal structure and an external structure for sealing an end of a container, vessel or conduit, for example. A safety seal is placed across a surface formed from the internal and external structures. Movement of either structure will cause the seal to break and indicate a violation of the integrity of the seal. The external structure will, in a closed position, force hooks of the internal structure into a groove of the container being sealed. Movement of the external structure into an open position will allow removal of the internal structure, together with the external structure, from the container being sealed. The container can be resealed by having the internal structure of the cap fitted onto the container, followed by displacement of the external structure to lock the hooks of the internal structure in place.

16 Claims, 1 Drawing Sheet

CONTAINER SAFETY CAP

FIELD OF THE INVENTION

The present invention relates to the field of an integral sealing cap for a container having the feature of indicating any breach of the integrity of the seal of the container.

BACKGROUND OF THE INVENTION

A bottle cap is an element that covers the outer periphery of a bottle's neck. The principal function of the cap is to impede the entrance or exit of fluids from the bottle.

To fulfill this function, the cap must be substantially immobilized and pressed onto the extreme periphery of the neck of the bottle. For this, one generally resorts to a subjection technique, consisting of an interaction of the form and plastic characteristics of the cap with the form of the bottle neck.

The twist-off cap is one example. The essence of the cap is the combination of two principles. The first of these is that a plastic liner seals the top of the bottle, and the second is that a surrounding cap presses down on the plastic liner. To be able to secure the cap, one must interact with some resource that is found disposed on the exterior of the bottle.

Another example is the crimp cap that is made of metal and which is mounted around the bottle. The cap is pressed around the neck of the bottle to copy the sinuous form of the bottle's peripheral end.

A bottle cap has previously been defined as an element to close the extreme end of a bottle that impedes the entrance or departure of elements from the bottle. Caps are differentiated between one another by their constituent material, by their form and by the technique used for their fixation on the extreme end of the bottle and their extraction from same.

SUMMARY OF THE INVENTION

The present invention is related to a cap for the cylindrical extreme of one end of a bottle or any other device that must be covered in a substantially hermetic way. This includes drums, conduits, pipes, and jars, to name but a few. They may be made of glass, plastic or metal.

The system includes two pieces differentiated between each other, of similar size, of which one contains the other, and which are inseparable.

The interior structure covers the peripheral border of the bottle's extreme peripheral surface and remains statically adhered to the sides of the bottle. The internal structure is substantially flexible at terminal arms or hooks that end in voluminous extremes. These voluminous extremes coincide in size and position with a groove or other system of hooking that surrounds the exterior end of the bottle. When the voluminous extremes are positioned in the groove, they can be surrounded by a ring, adjusted in size, which forms part of the external structure. The position of the cap is thereby effectively maintained on the cylindrical end, and is firmly maintained in that position, to cover with substantial hermeticity.

If this external structure, in which the interior structure is located, is slid upwards and moved from its position to a precise limit, then the arms that form the internal structure of the cap are allowed to stay free to flex. In this position, the external structure is elevated and overlies the internal structure in a way that the voluminous extremes or the hooks may be moved from the groove in the periphery of the bottle so that the whole cap is removable.

This cap is novel because of its special and innovative configuration which lets the internal structure adapt to the configuration of the bottle.

The bottle can be for a carbonated drink or any other drink system or size.

This is a cap whose constructive materials can be a thermoplastic materials that conjugates the characteristics of hardness and flexibility limited in accord with its form.

In synthesis:

It is a hermetic cap for use in a manually opened system.

It has an inviolable seal which is manually opened.

It has firmness for imprisonment and immobilization of its pieces.

It has hardness for protection and immobility in cases of hazardous usage.

It has the possibility of hermetically resealing, with the hand of the user, without the original seal.

It has the capability to be designed in a variety of measures, forms, and sizes.

OBJECTION OF THE SYSTEM

The first object of the system is to give the capability of its imprisonment to perfect a seal of the cap to the bottle or other devices to obtain hermeticity.

Another object of the system is to provide a method of sealing that guarantees the inviolability of the cap, with physical elements and visuals, that make the seal evident.

Another object of the system is to provide a method by which the person that decides to uncover or remove the cap of the bottle can do it by moving the fingers in a way without any danger or special abilities.

Another object of the system is to provide a method by which the actions needed to open and simultaneously breaking the seal are all performed in a single coordinated action.

Another object of the system is to provide a cap with proper characteristics such that give it the capability to resist different degrees of adverse contingencies of climatic order or handling, maintaining the attributes of the cap, with a seal.

Another object is to provide the forms and materials to the system, to be able to incorporate inscriptions, logos or signs of each product, and that these could be easily read or identified.

Another object of the system is to provide an opening method, whose demands may only be an action of twist and traction.

Another object of the system is that after being opened, the cap will not produce waste or loose parts, or have hanging parts or edges or projecting segments, or produce residues in the bottle.

Another object of the system is to allow reuse or to cover again by the user even if roughly removed, without the necessity of a technical means and while maintaining some original capability such as hermeticity, but evidencing that the original seal had already been opened.

Another object of the system is that, in determined industries, the alternative of commercial reuse of the cap can be obtained by reinserting a new seal and renewing then the characteristics that make the cap inviolable.

Another object of the system is to constantly maintain the pressure of the cap over the extreme end of the bottle.

Another object of the system is that the two positions by the telescopic action of the external structure with respect to the internal structure provides an elevated position to set free the cap and increases the surface area to be taken by the hands and fingers and in the secure position decreases the overall height of the cap.

Another object of the system is that for the matter of covering or recovering, it can easily be done by placing the cap in an "open" position and pressing the cap to the "closed" position also so as to be able to stick a safety seal on the top of the mating surfaces of the internal and external structures.

It has been observed that imperfections in the seal constitute the major cause of post-process contamination of aseptically processed foods and drinks. This is also valid for the pharmaceutical industry and other industries. Besides the contamination, the imperfection on the seal in the bottle cap permits the escape or entrance of fluids or other elements after establishing the equilibrium of the components of the bottle.

To cover the bottle according to the principles of the present invention, one takes the cap in an open position with the interior piece placed over the extreme end of the bottle in a position to cover the bottle. Then, to form the hermetic seal, the exterior piece is slid over the interior piece to a determined position, pressing the interior piece against the outlines of the bottle extremities.

To uncover, the exterior piece must be moved by sliding it over the interior piece. To uncover, it will be necessary to move the exterior structure, and that movement will break a seal formed on top of the interior and exterior structures.

The seal is established between an existent area between the top of the exterior structure and any area of the top of the interior structure. The union is from a part of the exterior piece with another part from the interior structure. A third element can be utilized that covers that area of the two pieces. This seal can be from plastic materials or paper or combination thereof that can be layered with colors. The seal secures the product when it is between the distribution chain and the hands of the consumer.

With this system, hard bottles can be utilized, such as glass, or soft bottles, such as plastic.

Other uses can be given to it, like in the case of a gas (propane) container, where it is necessary to protect a valve or faucet of each container. Over an outlet, a cap according to the inventive concepts of the present invention, can be placed, which is capable to resist interior pressure, if the technical exigencies are calculated, and besides will serve as a safety seal that the bottle was not tampered with.

The external structure surrounds the internal structure, and has a lower lip that is a ring, locked to the bottom of the internal structure in a locked position. The top of the external structure impedes descent when making contact with the top portion of the internal structure by frictional engagement.

The external surface of the external structure can be corrugated, or have a form that facilitates its manipulation to open or close or carry out movements as required for the invention.

The cap has an internal structure that surrounds the exterior wall of a bottle and has a protuberance in its extreme end in a ring form, that coincides with a depression in the exterior area of the bottle's extreme end to which it will adapt. The slots on a ring of the internal structure allow the ring to fit over the top of the bottle. The enlarged portions or hooks on each end portion of the slit ring engage the depression at the top of the bottle. There are eight equal vertical slots extending ⅔ of length from the bottom of the internal structure. The number of slots may vary with diameter of the object being sealed.

These and other objects of the invention, as well as many of the intended advantages, will become more readily apparent when reference is made to the following description taken in conjunction with the accompanying drawings.

DETAILED DESCRIPTION OF THE PREFERRED EMBODIMENTS

Figure 1:
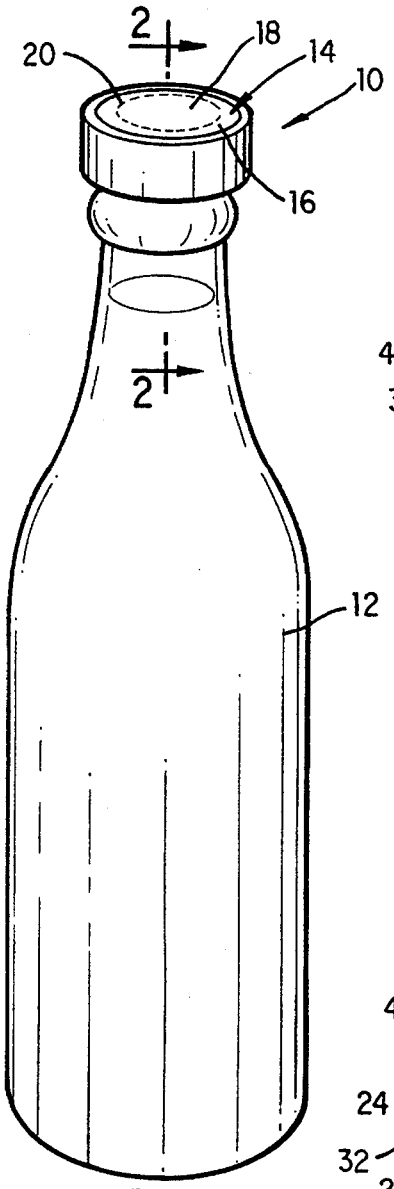
FIG. 1 is a perspective view of a container safety cap incorporating the principles of the present invention with the cap being mounted on an exemplary bottle for which the cap according to the present invention can be used, in combination, for sealing and resealing.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
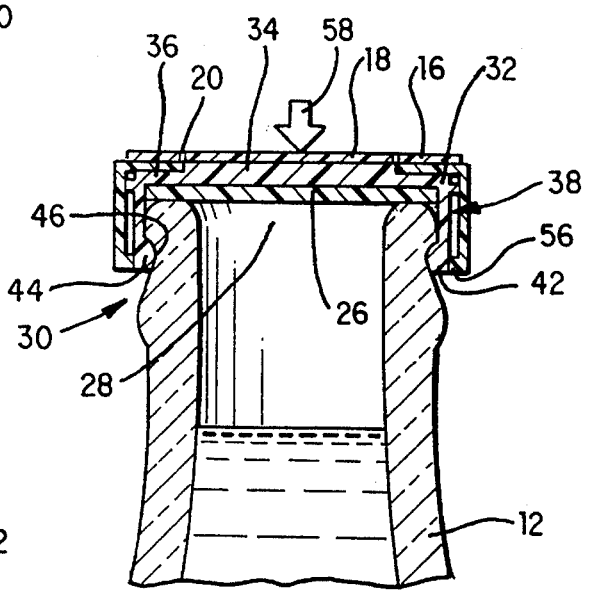
FIG. 2 is a sectional view taken along line 2—2 of FIG. 1 with the cap in a closed or sealed position.
Figure 3:
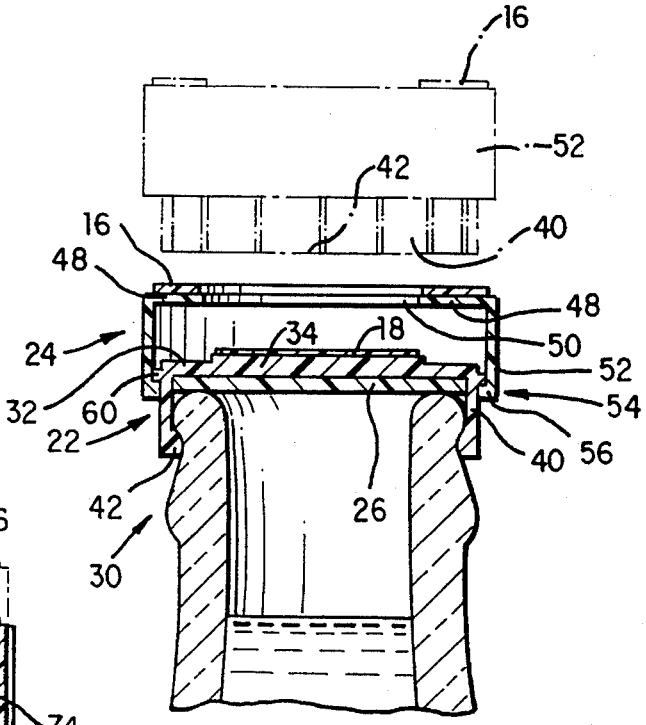
FIG. 3 is illustrative of the cap, in solid lines, in an open position, with the cap removed from the top of the bottle being shown in dotted lines.

With reference to the drawings, in general, and to FIGS. 1 through 3, in particular, a preferred embodiment of a container safety cap embodying the teachings of the subject invention is generally designated as 10. With reference to its orientation in FIG. 1, the container safety cap is shown mounted on top of a bottle 12. It is understood as being part of the present invention that the bottle 12 could be any other vessel, container or conduit onto which a sealing cap is required to be placed which is removable from and replaceable onto the vessel, container or conduit for access to the contents of the vessel, container or conduit and which may be resealed according to the principles of the present invention. The contents of the bottle 12, for example, may be carbonated or non-carbonated without affecting the scope of the present invention.

The cap 10 provides a resealable closure for a bottle 12, for example, and includes an indicator of an opening of the cap at any point after the original sealing of the bottle. As shown in FIG. 1, a pressure adhesive paper seal 14 includes an outer annular ring 16 connected to an inner circle 18 by a series of perforations or crease 20 which are arranged in a circle between the ring 16 and the circle 18 and which are easily separated. Other specialty materials may also be used. A breaking of the perforations 20 will be indicative of a possible lack of integrity of the seal of the bottle 12. This will alert consumers as to a possible breach of the security of the bottle.

In the construction of the cap 10 according to the principles of the present invention, the cap is formed of three pieces. The cap includes an interior structure 22, an exterior structure 24 slidably or rotatably mounted on the interior structure 22, and a membrane liner 26 mounted within the interior structure. Although the interior structure and exterior structure are moveable with respect to each other, they cannot be separated from each other.

As shown in FIG. 2, the membrane liner 26 lies across an opening 28 of an upper end of bottle 12. The liner is used to hermetically seal the opening 28 of the bottle 12.

The interior structure 22 includes a horizontally extending plate 32 having a raised upper peripheral portion 34 defining an annular ledge surface 36. Depending downwardly from the plate 32 is an annular skirt 38 which is divided into a plurality of segments 40 by slots. Preferably, there are eight equal sized slots extending upwardly two-thirds of the height of the skirt 38.

At a lower end 42 of each segment 40, is located a radially inwardly extending hock 44 formed of a bulbous portion of material. The hook 44 is shaped to have a complementary fit with a groove 46 formed at the upper end 30 of bottle 12.

The membrane liner 26 is engaged between the interior surface of the skirt 38 and the lower surface of the plate 32 to be forced onto the uppermost surface of end 30 of the bottle 12. The membrane liner thereby hermetically seals the opening 28 of the bottle 12.

In FIGS. 2 and 3, the exterior structure 24 surrounds and is slidably mounted on the interior structure 22. The exterior structure 24 includes, at an upper surface, an annular ring 48 defining a circular opening 50. The size of the opening 50 coincides with the diameter of the raised portion 34 of the plate 32 of the interior structure 22. Extending downwardly from the ring 48 is a skirt 52 terminating at a lower end 54 in a radially inwardly extending flange 56.

On downward movement of the exterior structure 24 in the direction of arrow 58, the flange 56 moves along the exterior surface of the skirt 38 of the interior structure and frictionally engages the radially outermost surface of the hook 44 to bias the hook 44 radially inwardly into the groove 46 of the upper end 30 of the bottle 12. The frictional engagement by the flange 56 of the hook 44 hermetically seals the open end 28 of the bottle 12 by the membrane liner 26. In this closed position, the cap 10 cannot be removed from the bottle 12 without a disengagement of the flange 56 from the hook 44.

To demonstrate the integrity of the seal of the bottle formed by the position of the flange 56 engaging the hook 44, a paper seal 14 is laid over the ring 48 seated on the ledge 36 with the raised portion 34 of the interior structure protruding through the opening 50 of the exterior structure to form a flat uppermost surface for the cap. As shown in FIG. 2, the ring 16 of the paper seal 14 overlays the ring 48 whereas the circle 18 of the paper seal 14 is located on the raised portion 34 of the plate 32. The paper seal 14 is adhesively, or by other means, sealed to the ring 48 and raised portion 34.

Upon movement of the ring 48 of the exterior structure with respect to the interior structure, the perforations 20 will be ruptured to indicate either rotation or longitudinal movement, in a direction of avertical axis, between the interior and exterior structures 22, 24. This would mean that the integrity of the seal of the opening 28 has potentially been violated. Since the approximate sizes of the ring 16 and circle 18 coincide with the approximate sizes of the ring 48 and raised portion 34, respectively, the relative movements of the interior and exterior structures with respect to each other are indicated by a breaking of the perforations 20 which is indicative of the integrity of the seal of the bottle.

In FIG. 3, the interior and exterior structures are shown in an open position, indicative of the upwards sliding of the exterior structure 24 with respect to the interior structure 22 due to the presence of circle 18 secured to the raised portion 34 of plate 32 and the ring 16 secured to the ring 48. In this open position, the flange 56 of the exterior structure 24 is slid upwardly until engaging radially outwardly projecting flange 60 extending from the interior structure adjacent to the plate 32.

In the elevated or open position of the exterior structure 24, the hooks 44 are no longer prevented from moving radially outwardly. It is now possible to remove the cap 10 from the bottle 12 by the use of the exterior structure 24, in its outwardly telescoped position, so as to provide increased leverage for tilting of the interior structure off of the top of end 30 of bottle 12.

From the position of the cap shown in dotted lines in FIG. 3, it is possible to reseal the bottle 12 by moving the interior structure 22 onto the end 30 of the bottle 12 in the open position as shown in solid lines in FIG. 3, and thereafter downwardly sliding the exterior structure 24 in the direction of arrow 58 to the position shown in FIG. 2. Of course, the perforations 20 would have been broken and the cap can either be used with the broken perforations with the knowledge that the integrity of the sealed bottle 12 has been violated or by the use of a new paper seal 14 which would indicate a new integrity of the seal of the bottle 12.

Figure 4:
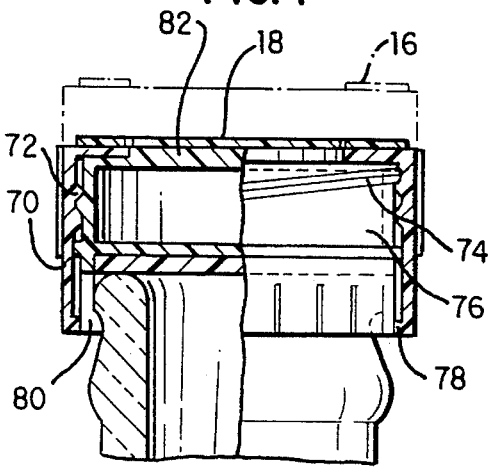
FIG. 4 is illustrative of an alternative embodiment of the cap which includes a screw connection for moving an exterior structure away from an interior structure of the cap.

In an alternate embodiment, as shown in FIG. 4, the exterior structure 70 is of a greater overall height so as to include interior threads 72 which cooperate with a radially extending thread 74 positioned on an extended skirt portion 76 of the interior structure. By a twisting of the exterior structure with respect to the interior structure, the flange 78 of the exterior structure is moved upwardly away from the hooks 80 of the interior structure to thereby elevate the exterior structure to the position shown in dotted lines in FIG. 4. The ring 16 of the seal 14 remains on the upper surface of the exterior structure and the circle 18 is secured to the raised portion 82 of the plate of the interior structure. Otherwise, the alternate embodiment of FIG. 4 operates in a similar manner as the cap shown in FIGS. 1 through 3.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A cap for a container, said cap comprising:

an internal structure and an external structure movable with respect to said internal structure, said internal structure including a plurality of flexible hooks for engaging a groove of the container, said external structure including a radially inwardly extending flange for engaging said hooks in a closed position and forcing said hooks to remain engaged in the groove of the container, and a safety seal positioned on a surface defined by cooperation between said internal structure and said external structure for indicating relative movement between said internal structure and said external structure, wherein said safety seal includes two portions interconnected to each other by perforations.

2. A cap for removably sealing a container, said cap comprising:

an internal structure and an external structure cooperating together for limiting displacement of one with respect to the other, said internal structure including hooks for removably engaging the container, said external structure including a flange for engaging said hooks in a closed position of minimal displacement between said internal structure and said external structure, and a seal positioned on said internal structure and said external structure for indicating movement between said internal structure and said external structure when said seal is broken, wherein said seal includes two portions interconnected to each other by perforations.

3. A cap for removably sealing a container, said cap comprising:

an internal structure and an external structure cooperating together for limiting displacement of one with respect to the other, said internal structure including hooks for removably engaging the containers, said external structure including a flange for engaging said hooks in a closed position of minimal displacement between said internal structure and said external structure, and a seal positioned on said internal structure and said external structure for indicating movement between said internal structure and said external structure when said seal is broken, wherein said seal includes a circular portion and an annular portion interconnected to said circular portion by perforations.

4. A cap according to claim 3, wherein said internal structure includes a flange cooperating with said flange of said external structure for limiting displacement of said external structure with respect to said internal structure.

5. A cap according to claim 3, wherein said external structure is slidable and rotatable with respect to said internal structure.

6. A cap according to claim 3, wherein said external structure threadingly engages said internal structure.

7. A cap according to claim 3, wherein a flexible membrane is contained within said internal structure.

8. A cap according to claim 3, wherein said internal structure includes a portion projecting through an opening in said external structure when the cap is in a closed position.

9. A cap according to claim 3, wherein said seal is adhered to said internal structure and said external structure.

10. A cap for a container, said cap comprising:

an internal structure and an external structure movable with respect to said internal structure, said internal structure including a plurality of flexible hooks for engaging a groove of the container, said external structure including a radially inwardly extending flange for engaging said hooks in a closed position and forcing said hooks to remain engaged in the groove of the container, and a safety seal position on a surface defined by cooperation between said internal structure and said external structure for indicating relative movement between said internal structure and said external structure, wherein said safety seal includes a circular portion and an annular portion interconnected to said circular portion by perforations.

11. A cap for a container, said cap comprising:

an internal structure and an external structure movable with respect to said internal structure, said internal structure including a plurality of flexible hooks for engaging a groove of the container, said external structure including a radially inwardly extending flange for engaging said hooks in a closed position and forcing said hooks to remain engaged in the groove of the container, and a safety seal positioned on a surface defined by cooperation between said internal structure and said external structure for indicating relative movement between said internal structure and said external structure, wherein said internal structure includes a radially outwardly extending flange cooperating with said radially inwardly extending flange of said external structure for limiting displacement of said external structure with respect to said internal structure.

12. A cap according to claim 11, wherein said external structure is slidable and rotatable with respect to said internal structure.

13. A cap according to claim 11, wherein said external structure threadingly engages said internal structure.

14. A cap according to claim 11, wherein a flexible membrane is contained within said internal structure.

15. A cap according to claim 11, wherein said internal structure includes a portion projecting through an opening in said external structure when the cap is in a closed position.

16. A cap according to claim 11, wherein said safety seal is adhered to said internal structure and said external structure.

* * * * *